United States Patent [19]

Matsui et al.

[11] Patent Number: 4,687,356

[45] Date of Patent: Aug. 18, 1987

[54] ELECTRONIC PRINTER WITH INTERLEAVED STORAGE OF PRINT WHEEL POSITION, HAMMER INTENSITY, AND CARRIAGE POSITION DATA IN READ ONLY MEMORY

[75] Inventors: Hirotoshi Matsui, Nara; Takeo Tsumura, Matsubara; Eiichi Sakanaka, Yamatokoriyama, all of Japan

[73] Assignee: Sharp Kabushiki Kaisha, Osaka, Japan

[21] Appl. No.: 748,985

[22] Filed: Jun. 26, 1985

[30] Foreign Application Priority Data

Jul. 2, 1984 [JP] Japan ..... 59-137584

[51] Int. Cl.[4] ..... B41J 1/30

[52] U.S. Cl. ..... 400/144.2; 400/157.3; 400/320

[58] Field of Search ..... 400/144.2, 144.3, 157.3, 400/166, 171, 174, 175, 320

[56] References Cited

U.S. PATENT DOCUMENTS

| | | | |
|---|---|---|---|
| 3,858,509 | 1/1975 | Grundherr | 400/144.2 X |
| 4,026,403 | 5/1977 | Inose et al. | 400/171 X |
| 4,074,798 | 2/1978 | Berger | 400/144.3 |
| 4,118,129 | 10/1978 | Grundherr | 400/144.2 |
| 4,189,246 | 2/1980 | Kane et al. | 400/51 X |
| 4,217,055 | 8/1980 | Moon | 400/144.2 |
| 4,264,220 | 4/1981 | Okcuoglu | 400/144.2 |
| 4,314,769 | 2/1982 | James, III | 400/144.2 |
| 4,386,862 | 6/1983 | Kittel et al. | 400/144.2 |
| 4,541,746 | 9/1985 | Bobart et al. | 400/144.2 |

FOREIGN PATENT DOCUMENTS

| | | | |
|---|---|---|---|
| 0042206 | 12/1981 | European Pat. Off. | 400/144.2 |
| 1604577 | 12/1981 | United Kingdom | 400/157.3 |
| 2093244 | 8/1982 | United Kingdom | 400/144.2 |
| 2110853 | 6/1983 | United Kingdom | 400/144.2 |

OTHER PUBLICATIONS

IBM Technical Disclosure Bulletin, "Character Wheel for Low-Cost Changeable Font Printer, Branson et al, vol. 16, No. 5, Oct. 1973, p. 1515.

*Primary Examiner*—Ernest T. Wright, Jr.

*Attorney, Agent, or Firm*—Birch, Stewart, Kolasch & Birch

[57] ABSTRACT

An impact-type electronic printer uses a rotary printing wheel and a ROM to store printing-type position data for dealing with respective printing types borne by the rotary printing wheel, hammer pressure data, and the spacing data respectively matching the designated printing types together with printing-type position data. The main CPU then draws out the printing-type position data, hammer pressure data, and the spacing data in response to the input data to allow the printer to execute the printing operation using the designated printing types in accordance with these data drawn out of the ROM, thus realizing distinctly clean printed characters. The unique system embodied by the present invention makes it possible for the controller to easily read important data from the ROM. In other words, since the control system reflecting the present invention allows the ROM to effectively store the printing-type position data, hammer pressure data, and the specifying data in two words, the control system can, for example, securely read the data merely by executing the reading operations twice.

3 Claims, 5 Drawing Figures

ELECTRONIC PRINTER WITH INTERLEAVED STORAGE OF PRINT WHEEL POSITION, HAMMER INTENSITY, AND CARRIAGE POSITION DATA IN READ ONLY MEMORY

BACKGROUND OF INVENTION

The present invention relates to an electronic printer, e.g. an impact-type electronic printer using a rotary printing wheel.

Conventional electronic printers are designed to realize a uniform printing depth by varying the hammer pressure for each printing type.

Such a conventional electronic printer prints out characters and symbols cleanly with a uniform depth by continuously controlling the depth of the printed chracters according to their size. However, the conventional electronic printer cannot produce completely clean print merely by controlling the depth of the printed characters and symbols. In fact, cleaner printing can only be realized by adequately varying the spacing so that the next character is set in its printing position with reference to the size of the printing type. To achieve this, the controller system should be provided with a variety of specific spacing data for adequately varying the space in accordance with the magnitude of the areas of the respective printing type. Therefore, it is necessary to independently draw out from the ROM printing-type position data, hammer pressure and spacing data in response to the input data that represents the printable character. Actually, no conventional electronic printer can smoothly extract such data from the ROM, because it involves the entire circuitry in complex operations.

SUMMARY OF THE INVENTION

The present invention primarily aims at providing distinctly cleaner characters than can be printed with impact-type electronic printers using a rotary printing wheel. Another object of the present invention is to provide the impact-type electronic printer with a means for indpendently storing both hammer pressure data and spacing data to correctly match the respective printing types and such means for effectively and smoothly drawing out the printing-type position data, hammer pressure data, and the spacing data from the memory means (ROM). Briefly described, in accordance with the present invention, an impact-type electronic printer using a rotary printing wheel reflecting the preferred embodiment of the present invention enables the ROM to store the printing-type position data for the printing types borne by the rotary printing wheel, the hammer pressure data, and the spacing data matching the designated printing types together with the printing-type position data. The main CPU then draws out the printing-type position data, the hammer pressure data, and the spacing data in response to the input data to allow the printer to execute the printing operation using the designated printing types in accordance with these data drawn out of the ROM, thus realizing distinct, clean printed characters.

The unique system embodied by the present invention makes it possible for the controller to easily read important data from ROM. In other words, since the control system reflecting the present invention allows the ROM to effectively store the printing-type position data, hammer pressure data, and spacing data in two words, the control system can, for example, read this data merely by executing the reading operation twice.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENT

Figure 1:
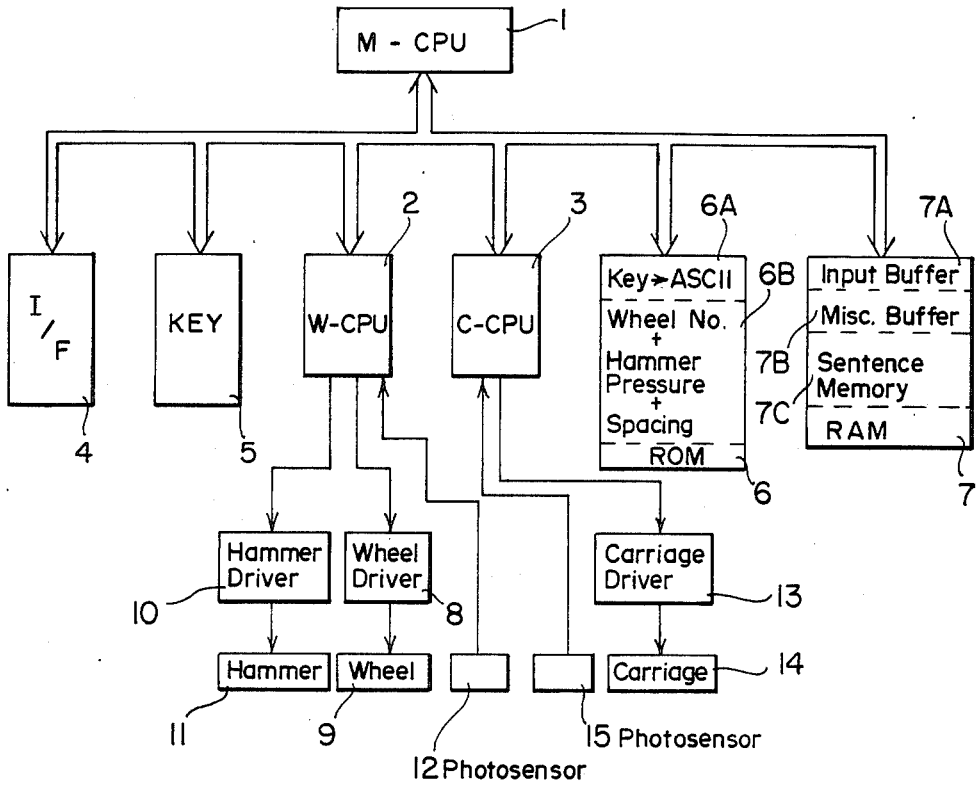
FIG. 1 is a simplified block diagram of the control circuit of the electronic printer embodied by the present invention, which is typically applied to a typewriter.

FIG. 1 is a simplified block diagram of the control circuit of the electronic printer embodied by the present invention, as typically applied to typewriters. Reference number 1 indicates the 8-bit main CPU of the typewriter reflecting the preferred embodiment of the present invention. Reference numbers 2 and 3 indicate the 8-bit subordinate CPUs. Of these, the wheel CPU (W-CPU) 2 controls the operations of both the rotary printing wheel 9 and the hammer 11, whereas the carriage CPU (C-CPU) 3 controls the operation of the carriage 14. Reference number 4 indicates the interface connected to external data sources which deliver the ASCII code to this interface 4. Reference number 5 indicates the keyboard unit that receives the key-code character data. Reference number 6 indicates the ROM which is provided with table 6A and which converts the key codes into the ASCII code, table 6B which stores the printing-type position data (WHEEL NO.) designating the physical positions of the respective printing types or elements (24 of FIG. 4) of the rotary printing wheel 9, hammer pressure data, and spacing data, while ROM 6 also contains other tables storing control programs. Reference number 7 indicates the RAM containing the input buffer 7A, the miscellaneous buffer 7B, and the sentence memory area 7C.

Reference number 8 indicates the printing-wheel driver connected to the W-CPU 2. Reference number 9 indicates the rotary printing wheel controlled by the wheel driver 8. Reference number 10 indicates the hammer driver connected to the W-CPU 2. Reference number 11 indicates the hammer controlled by the hammer driver 10. Reference number 12 indicates the photosensor (optical rotary encoder) that detects the position of the rotary printing wheel 9 and delivers the data related to the position of this wheel to the W-CPU 2. Reference number 13 indicates the carriage driver connected to the C-CPU 3 and reference number 14 indicates the carriage controlled by the carriage driver 13. Reference number 15 indicates the photosensor (optical rotary encoder) that detects the position of the carriage 14 and delivers data regarding the moving position of the carriage 14 to the C-CPU 3. The carriage 14 is provided with the rotary printing wheel 21 and the hammer 27 shown in FIG. 5.

Figure 2:
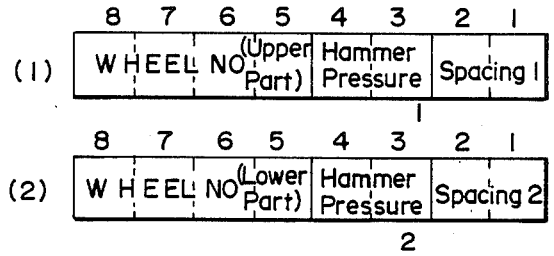
FIG. 2 is the composition of the printing-type position data, hammer pressure data, and spacing data stored in ROM.

Referring now to FIG. 2, the composition of the printing-type position data (wheel number) related to the respective printing types of the rotary printing wheel 9, hammer pressure data, and the spacing data stored in the ROM 6 is described below. The rotary printing wheel 9 bears 112 printing types. The printing-type position data is composed of 8 bits. Although 7-bit data composition is quite sufficient for selecting any of these 112 printing types, the 8th bit is made available for providing data related to composite symbols such as $ (dollar) and ¥ (yen), and as a result, a maximum of 8 bits are made available. In the preferred embodiment of the present invention, the hammer pressure data and the spacing data are respectively composed of 4 bits to allow the control system of the printer to apply a maximum of 16 levels of hammer pressure and space adjustment. Therefore, the electronic printer incorporating the preferred embodiment of the present invention enables the ROM 6 to constantly store together the 8-bit printing-type position data, the 4-bit hammer pressure data, and the 4-bit spacing data. The ROM 6 is provided with 2 stages, i.e., 2 address positions dealign with each printing type. As shown in FIG. 2 (1), the first stage stores the upper 4-bit contents of the 8-bit printing-type position data, the upper 2-bit contents of the 4-bit hammer pressure data, and the upper 2-bit contents of the 4-bit spacing data. On the other hand, the second stage in FIG. 2(2) stores 8-bit data comprised of the lower 4-bit contents of the 8-bit printing-type position data, the lower 2-bit contents of the 4-bit hammer pressure data, and the lower 2-bit contents of the 4-bit spacing data. In addition, the ROM 6 stores the data relating to the 112 printing types, for example the first and second stages would be provided with the n-th through (224+n)th addresses.

At least one kind of the printing-type position data, hammer pressure data, and the spacing data described above may be divided into one-half when the divided data is stored in the ROM 6. Needless to say, each element of this data may also be divided into any number of desired parts other than one-half.

Figure 4:
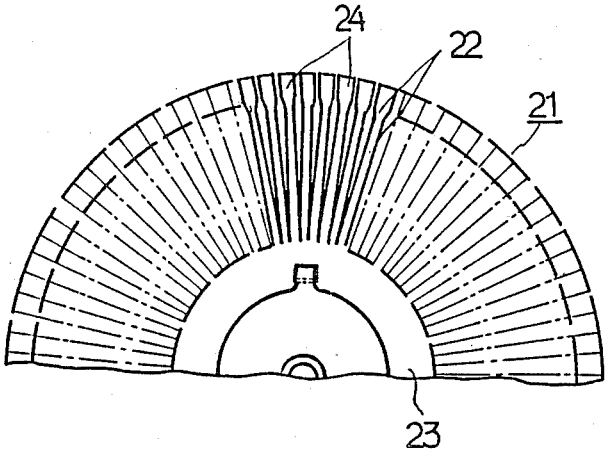
FIG. 4 is the configuration of the rotary printing wheel.
Figure 5:
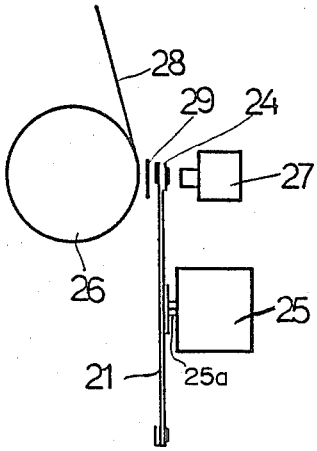
FIG. 5 is the simplified configuration of an electronic printer provided with a rotary printing wheel.

Rotary wheel electronic printers use a rotary printing wheel 21 in FIG. 4. The rotary printing wheel 21 has a number of spokes 22, 22—almost all identical in shape. Each spoke 22, 22—radially extends from the center hub 23 and bears a printing type 24 at its tip, forming part of the external circumference of the rotary printing wheel 21. Printing types 24 include upper case and lower case characters, numerals, and a variety of symbols. As shown in FIG. 5, the rotary printing wheel 21 is driven by the rotating shaft 25*a* of the drive motor 25 mounted on the carriage 14 of FIG. 1. The drive motor 25 controls the rotation of the rotary printing wheel 21 so that the desired printing type 24 can be set in the correct printing position where the platen 26 and the hammer 27 match each other exactly. By causing the hammer 27 to hit the rear surface of the designated printing type 24 in the direction of the platen 26, the designated printing type 24 performs the printing and recording of the required data on the recording paper 28 in front of the platen 26 via an ink ribbon 29.

Figure 3:
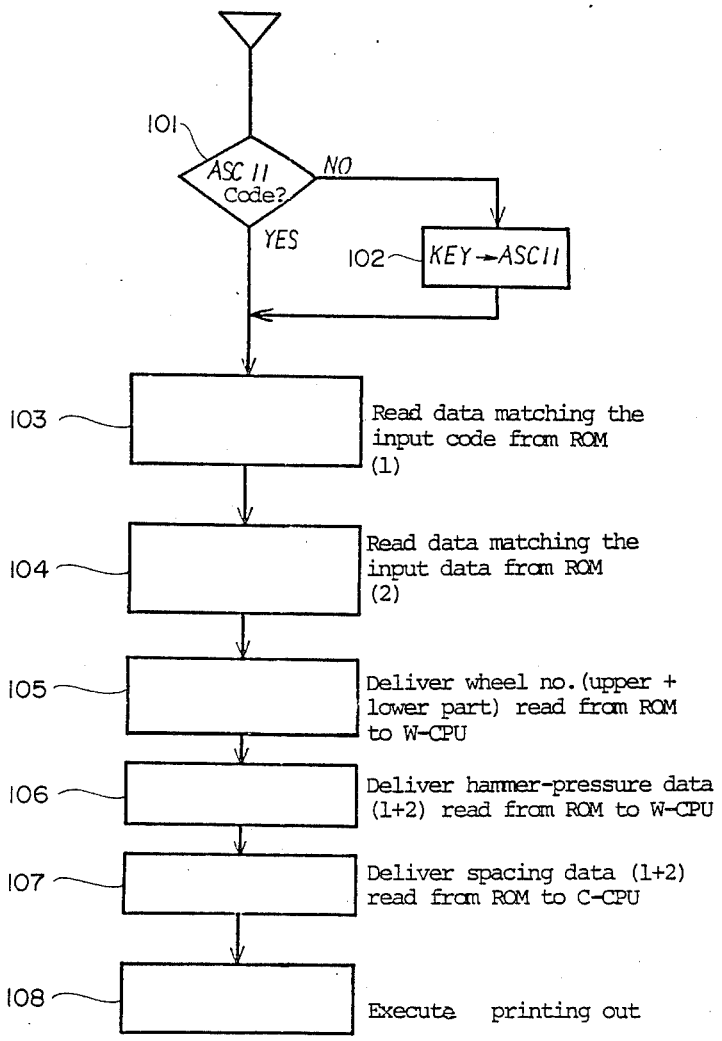
FIG. 3 is a flowchart describing the operation of the electronic printer embodied by the present invention.

Referring now to the operation chart of FIG. 3, the operations of the control system reflecting the preferred embodiment of the present invention are described below. First, when data designating the printable character is input, the main CPU 1 identifies in step 101 whether or not the input data belongs to the ASCII code. The input data transmitted from the external data sources via the interface 4 belongs to the ASCII code whereas the data input from the keyboard unit 5 belongs to the key code. When the key code is input, the main CPU 1 converts in step 102 the key-coded input data into the ASCII code by referring it to the conversion table 6A of ROM 6. As a result, all input data are standardized into the ASCII code. The ASCII-coded data from the interface 4 and such data converted into the ASCII code from the keyboard unit 5 are temporarily stored in the input buffer 7A of the RAM 7. The main CPU 1 then reads data out from the ROM 6 by addressing the positions that match the input data stored in the ROM 6. In this way, the printing-type position data, hammer pressure data, and the spacing data respectively match the ASCII code and can be correctly received from the table 6B of the ROM 6. As a result, the first-stage data shown in FIG. 2(1) (comprised of the 8-bit data containing the upper 4-bit contents of the printing-type position data, the upper 2-bit contents of the hammer pressure data, and the upper 2-bit contents of the spacing data) are read out of the ROM 6 in step 103 and then temporarily stored in the buffer 7A of the RAM 7. Next, the second-stage data in FIG. 2(2) (comprised of the 8-bit data containing the lower 4-bit contents of the printing-type position data, the lower 2-bit contents of the hammer pressure data, and the lower 2-bit contents of the spacing data) are also read out of the ROM 6 in step 104 and temporarily stored in the buffer 7A of the RAM 7. After the main CPU 1 has read the 2-stage data out of the ROM 6, both the upper and lower 4-bit contents of the printing-type position data stored in the RAM 7 are then integrated into the 8-bit printing-type position data for delivery to the W-CPU 2 in step 105. Next, both the upper and lower 2-bit contents of the hammer pressure data are integrated into the 4-bit data, which is then provided with control data before being delivered to the W-CPU 2 in step 106. Likewise, the upper and lower 2-bit contents of the spacing data are integrated into the 4-bit spacing data, which is also provided with control data before eventually being delivered to the W-CPU 3 in step 107. The electronic printer system then proceeds to the printing operation in step 108. First, the main CPU 1 executes a specific operation in reference to the spacing data received from the C-CPU 3 and then generates the spacing data for providing the optimum spaces in advance of and behind the designated printing type. The main CPU 1 then controls the operation of the carriage driver 13 in response to the advance spacing data before activating the carriage 14 to move its position. The main CPU 1 then controls the operation of the printing wheel driver 8 in response to the printing-type position data fed from the W-CPU 2 in order that the rotary printing wheel 9 can precisely rotate itself up to the designated position where the designated printing type 24 matching the input data executes the printing operation. On the other hand, using the hammer pressure data received, the W-CPU 2 controls the operation of the hammer driver 10 to drive the hammer 11 at the moment when the printing type of the rotary printing wheel 9 matching the input data stops at the printing position so that the printing can be executed at the optimum pressure as determined by the hammer pressure data. Next, after completing the printing operation, by activating the hammer 27 to hit the back of the designated printing type 24, the C-CPU 3 then controls the operation of the carriage driver 13 in accordance with the post-print spacing data. This causes the carriage 14 to move its position. By applying these serial operations, the printing cycle for each printing type 24 is completed. The desired characters and symbols are thus sequentially printed and recorded by repeatedly executing these serial operations whenever the input data designating the desired characters and symbols are received.

While only certain embodiments of the present invention have been described, it will be apparent to those skilled in the art that various changes and modifications may be made therein without departing from the spirit and scope of the present invention as claimed.

What is claimed is:

1. An electronic printing assembly for sequentially printing characters along a printing row comprising:

a rotary print wheel including a plurality of print types disposed about a circumference of said print wheel;

means, connected to said rotary print wheel, for rotating said wheel to present a desired print type to a printing position adjacent said printing row;

a carriage supporting said means for rotating and said rotary print wheel;

means, connected to said carriage, for shifting said carriage to a desired position along said printing row;

impact means for striking a said type when at said printing position to print a character associated with said type thereat, said impact means applying a variable impact pressure to each said type to apply the optimum pressure to each said type;

means for introducing characters to be printed;

read only memory means for storing position data associated with the print wheel position of the type associated with each character, hammer pressure data associated with the variable impact pressure of each character, and spacing data associated with each character and representing a spacing thereof and thus a shift distance for said carriage in an interleaved fashion, said read only memory means storing said position data, hammer pressure data and spacing data associated with each character in two words with said position data being stored, in part, in both of said words;

wheel control means, responsive to said position data and said hammer pressure data, for controlling said means for rotating to rotate said print wheel to said printing position and for controlling said impact means to vary the impact pressure applied to each said type;

carriage control means, responsive to said spacing data, for controlling said means for shifting to shift said carriage to said desired position adjacent said printing row; and control means, responsive to said means for introducing, for addressing said read only memory means to access said position data, hammer pressure data and spacing data as information associated with each introduced character and for presenting said information to said wheel control means and said character control means;

said control means for addressing transferring said data from a first one of said two words to said wheel control means and carriage controls means and then subsequently transferring data from said second one of said two words to said wheel control means and carriage control means to substantially simultaneously transfer said position data, hammer pressure data and spacing data associated with a said introduced character to said wheel control means and carriage control means.

2. The printing assembly of claim 1 wherein said hammer pressure data and spacing data associated with each said introduced character are stored, in part, in both said words.

3. The printing assembly of claim 2 wherein said wheel control means controls said means for rotating after said wheel position data is transferred by said control means for addressing.

* * * * *